US008662293B2

(12) United States Patent
Lazott et al.

(10) Patent No.: US 8,662,293 B2
(45) Date of Patent: Mar. 4, 2014

(54) BADGE HOLDER WITH EJECTOR

(71) Applicant: Brady Worldwide, Inc., Milwaukee, WI (US)

(72) Inventors: Robert Lazott, Billerica, MA (US); Scott M. Collins, Chicago, IL (US); Luc Chuong Lam, Chicago, IL (US); Andrew B. Terrill, Prairie du Sac, WI (US); Michael Barczak, Watertown, WI (US); Edward A. Raleigh, Lodi, WI (US); Kevin Kerwin, Madison, WI (US)

(73) Assignee: Brady Worldwide, Inc., Milwaukee, WI (US)

( * ) Notice: Subject to any disclaimer, the term of this patent is extended or adjusted under 35 U.S.C. 154(b) by 0 days.

(21) Appl. No.: 13/774,562

(22) Filed: Feb. 22, 2013

(65) Prior Publication Data

US 2013/0220842 A1 Aug. 29, 2013

Related U.S. Application Data

(60) Provisional application No. 61/602,982, filed on Feb. 24, 2012.

(51) Int. Cl.
*A45C 11/18* (2006.01)

(52) U.S. Cl.
USPC ..... 206/39.4

(58) Field of Classification Search
USPC ..... 206/39, 39.4, 39.5; 150/147, 148, 149; 221/232, 176
See application file for complete search history.

(56) References Cited

U.S. PATENT DOCUMENTS

| | | | | | |
|---|---|---|---|---|---|
| 2,533,577 | A | * | 12/1950 | Godfrey | 206/315.1 |
| 3,688,896 | A | * | 9/1972 | Newell | 206/39 |
| 4,697,698 | A | | 10/1987 | Holdener | |
| 4,887,739 | A | * | 12/1989 | Parker | 221/232 |
| 5,107,073 | A | * | 4/1992 | Steffen | 174/563 |
| 5,125,505 | A | * | 6/1992 | Kurosaki | 206/39.4 |
| 5,337,813 | A | | 8/1994 | Ritter | |
| 6,155,410 | A | * | 12/2000 | Davis | 206/39.5 |
| 6,964,350 | B1 | * | 11/2005 | Padilla | 221/199 |

* cited by examiner

*Primary Examiner* — Jacob K Ackun
(74) *Attorney, Agent, or Firm* — Quarles & Brady LLP

(57) ABSTRACT

A badge holder for holding a badge includes a front piece and a back piece opposite the front piece. The back piece is coupled to the front piece to provide a holding slot for the badge. A first ejector has a proximal end and a distal end. The proximal end is rotatably coupled to at least one of the front piece and the back piece. The first ejector is configured to rotate such that the distal end forces at least a portion of the badge out of the holding slot.

22 Claims, 8 Drawing Sheets

12
14
22
24
16
70
20
38
42
78
76
82
80
46
34
28
36
74
72
18
52
56
10
32
50
54
26
48
30
60
58

BADGE HOLDER WITH EJECTOR

CROSS REFERENCE TO RELATED APPLICATIONS

This application claims priority to U.S. Provisional Patent Application No. 61/602,982, filed Feb. 24, 2012, the contents of which are incorporated by reference as if set forth in their entirety herein for all purposes.

STATEMENT OF FEDERALLY SPONSORED RESEARCH OR DEVELOPMENT

Not applicable.

FIELD OF THE INVENTION

The present invention relates to badge or card holders. More particularly, the invention relates to an ejector on a badge holder that may be used to partially remove a badge, thereby allowing a user to fully remove the badge from the badge holder.

BACKGROUND

Holders for identification badges or cards are widely used by employees to hold identification information for badges or cards that provide access to certain facilities. Holders are also used in other contexts, such as for storing other types of cards, including debit cards, credit cards, and the like. Some holders are even designed to hold more than one badge or card. These holders may serve several purposes, including helping to protect the card or badge that they hold, providing a specific holding location for the badge such that the user does not misplace the badge, and providing easy access to the badge so that the user can quickly remove the card to identify themselves or use the card or badge for its intended purpose.

Badge holders are often made of a pliable plastic that allow the badge holder to be pinched to provide access to the badge they hold. Once the badge holder is pinched, the user can remove the badge by inserting his or her fingers into the space or cavity between the walls of the holder created by the pinching action. Badge holders may alternatively include a slot cut into one or more faces of the holder to allow a user's thumb or finger to urge or remove the badge from the holder. However, both of these types of removal systems have their disadvantages.

For example, repeated bending of the badge holder may create repetitive stress points on the badge holder or deformation of the badge holder that cause the badge holder to tear, fracture, or remain of such a shape that the badge holder does not properly retain the badge. Furthermore, large slots in the badge holder may allow foreign matter, such as dust and dirt, to enter the badge holder which can compromise certain features of the card. Additionally, each of the above-described removal systems usually require the user to use both hands to remove the card, including one hand for holding or manipulating the holder and the other hand for removing the card.

Other systems have been developed for removing a badge or card from a badge holder, such as U.S. Pat. No. 5,337,813. However, these systems involve complicated assembly and only provide the ability to remove a single badge, or all badges, residing in the badge holder.

SUMMARY OF THE INVENTION

According to one aspect, the present invention provides for a badge holder for holding a badge. The badge holder includes a front piece and a back piece. The back piece is opposite from the front piece and is coupled to the front piece to provide a holding slot for a badge. A first ejector has a first arm, a first proximal end and a first distal end. The first proximal end is rotatably coupled to at least one of the front piece and the back piece. The first ejector is configured to rotate such that the first arm of the first distal end forces at least a portion of the badge out of the holding slot.

In another aspect, the invention provides for a badge holder for holding a first badge and a second badge. The badge holder includes a housing that includes a front piece, a back piece, and a divider. The back piece is opposite from the front piece. The divider is between the front piece and the back piece. This divider is coupled to the front piece and the back piece. The divider provides a first holding slot for the first badge and a second holding slot for the second badge. The badge holder further includes a first ejector and a second ejector. The first ejector has a first proximal end and a first distal end. The first proximal end is rotatably coupled to the housing. The first ejector is configured to rotate in the first holding slot such that the first distal end contacts the first badge and forces at least a portion of the first badge out of the first holding slot. The second ejector has a second proximal end and a second distal end. The second proximal end is rotatably coupled to the housing. The second ejector is configured to rotate in the second holding slot such that the second distal end contacts the second badge and forces at least a portion of the second badge from the second holding slot.

In yet another aspect, the invention provides for a badge holder for holding a first badge and a second badge. The badge holder includes a housing that includes a front piece and a back piece, the back piece being opposite from the front piece and spaced apart from the front piece. The housing also includes a badge divider between the front piece and the back piece that is coupled to the front piece and the back piece. The badge divider provides a first holding slot for the first badge and a second holding slot for the second badge. The badge holder also includes a first pin, a second pin, a first ejector, and a second ejector. The first ejector includes a first arm, a first proximal end and a first distal end. The first proximal end is rotatably coupled to the first pin and is configured to rotate about the first pin in the first holding slot such that first arm of the first distal end contacts the first badge and forces at least a portion of the first badge out of the first holding slot. The second ejector includes an arm, a second proximal end and a second distal end. The second distal end is rotatably coupled to the second pin and is configured to rotate in the second holding slot such that the arm of the second distal end contacts the second badge and forces at least a portion of the second badge from the second holding slot. The first ejector forces the portion of the first badge out of the first holding slot without forcing the portion of the second badge out of the second holding slot and the second ejector forces the portion of the second badge out of the second holding slot without removing the portion of the first badge out of the first holding slot.

These and other features, aspects, and advantages of the present invention will become better understood upon consideration of the following detailed description, drawings and appended claims.

DETAILED DESCRIPTION OF THE PREFERRED EMBODIMENTS

This application generally refers to "badge holders" and "badges", yet the invention is not intended to be confined to holders for only badges. Rather, the term "badge holder" and "badge" are intended to encompass any holder for any type of card or badge, including, but not limited to, identification badges, identification cards, access cards, security cards, debit cards, credit cards, and the like. Thus, the term "badge" and "badge holder" are not intended to be limiting, but are used throughout for the purposes of consistency and brevity.

Figure 2:
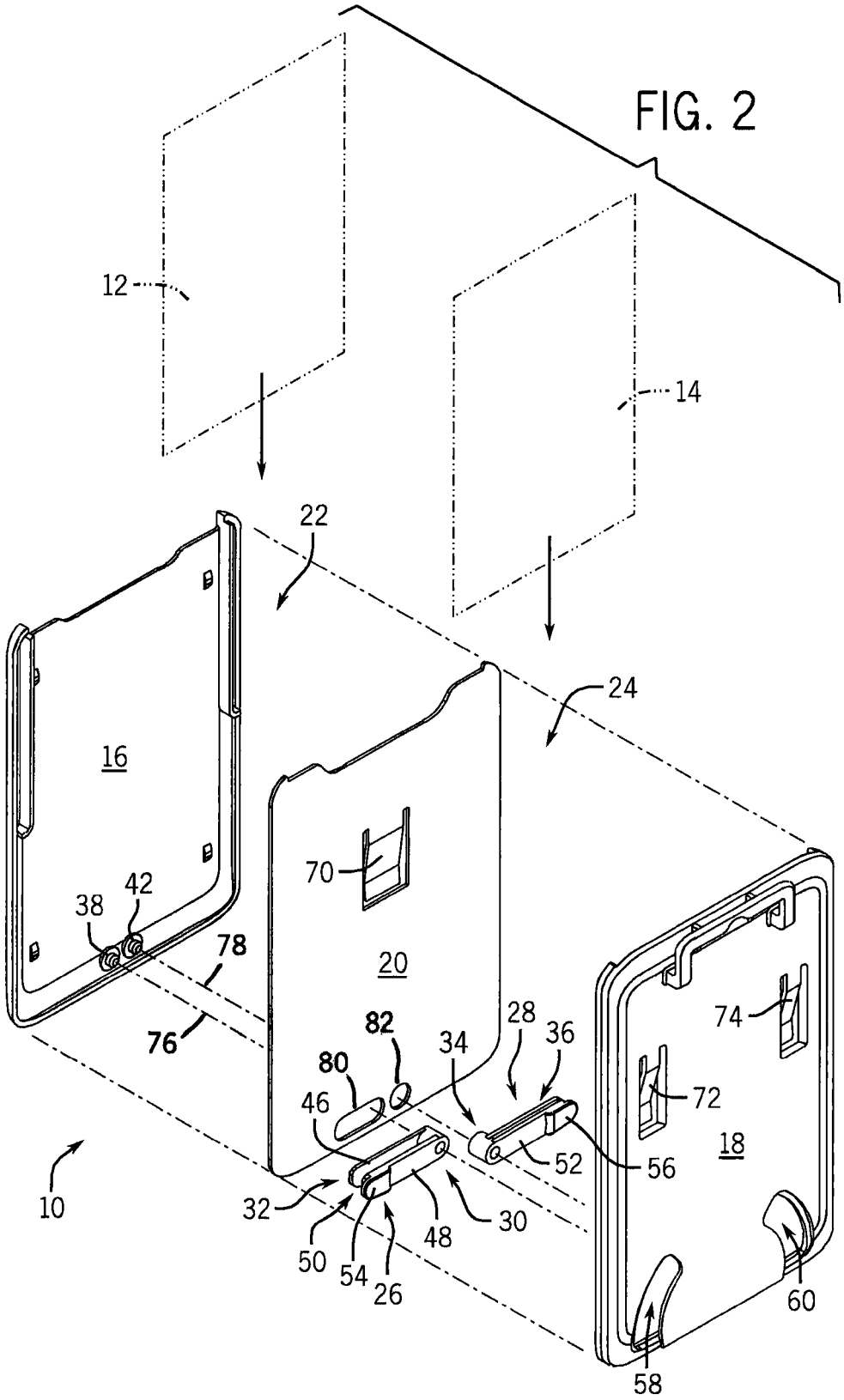
FIG. 2 is an exploded view of the badge holder taken from perspective rear view.

Referring to FIGS. 1-6, a badge holder 10 is shown. The badge holder 10 shown in FIGS. 1-6 is configured to hold a first badge 12 and a second badge 14. However, it is contemplated that the badge holder 10 could also be configured to hold only one badge or more than two badges. As best shown in FIG. 2, the badge holder 10 includes a housing 11 that includes a front piece 16, a back piece 18, and a divider 20. The front piece 16 is coupled to the back piece 18. The back piece 18 is spaced apart from and is opposite the front piece 16. The housing 11 may be constructed of a transparent material such that at least a portion of the badges 12, 14 are visible through the housing 11 when the badges are inserted into the housing 11.

The coupling of the front piece 16 to the back piece 18 and the placement of the divider 20 between the front piece 16 and the back piece 18 is arranged to define open-ended slots 22, 24. The divider 20 is coupled to the front piece 16 and back piece 18 and is placed between the front piece 16 and the back piece 18. The divider 20 provides a first holding slot 22 for a first badge 12 between the divider 20 and the front piece 16. The divider 20 also provides a second holding slot 24 for a second badge 14 between the divider 20 and the back piece 18.

In the illustrated embodiment, the front piece 16 and the back piece 18 are generally rectangular shaped and have three of their peripheral edges attached to one another. The peripheral edges might be directly joined to one another, might be locked together via an intermediate frame element or elements, or might be attached in other ways. The peripheral edges of the front and back pieces 16, 18 that are not joined are disposed on the edge of the periphery on which the open-ended slots 22, 24 are accessible. In some forms of construction, the divider 20 placed between the front and back pieces 16, 18 may be directly attached to one or both of the front and back pieces 16, 18, may serve as an intermediate connecting element between the front and back pieces 16, 18, or may be mechanically captured between the front and back pieces 16, 18. For example, the peripheral edges of the front and back pieces 16, 18 that are joined to one another (or connecting frame parts) may be designed to directly connect to one another, but to provide a space such as a shaped recess that can receive and capture the divider 20 there between. As another example, one or both of the front and back pieces 16, 18 may have short connecting posts that are used to connect the front and back pieces 16, 18 together. In this arrangement, the divider 20 might have openings corresponding to these posts about its periphery and the posts may interact with these openings to lock the divider in place when the front and back pieces 16, 18 are joined to one another.

Figure 1:
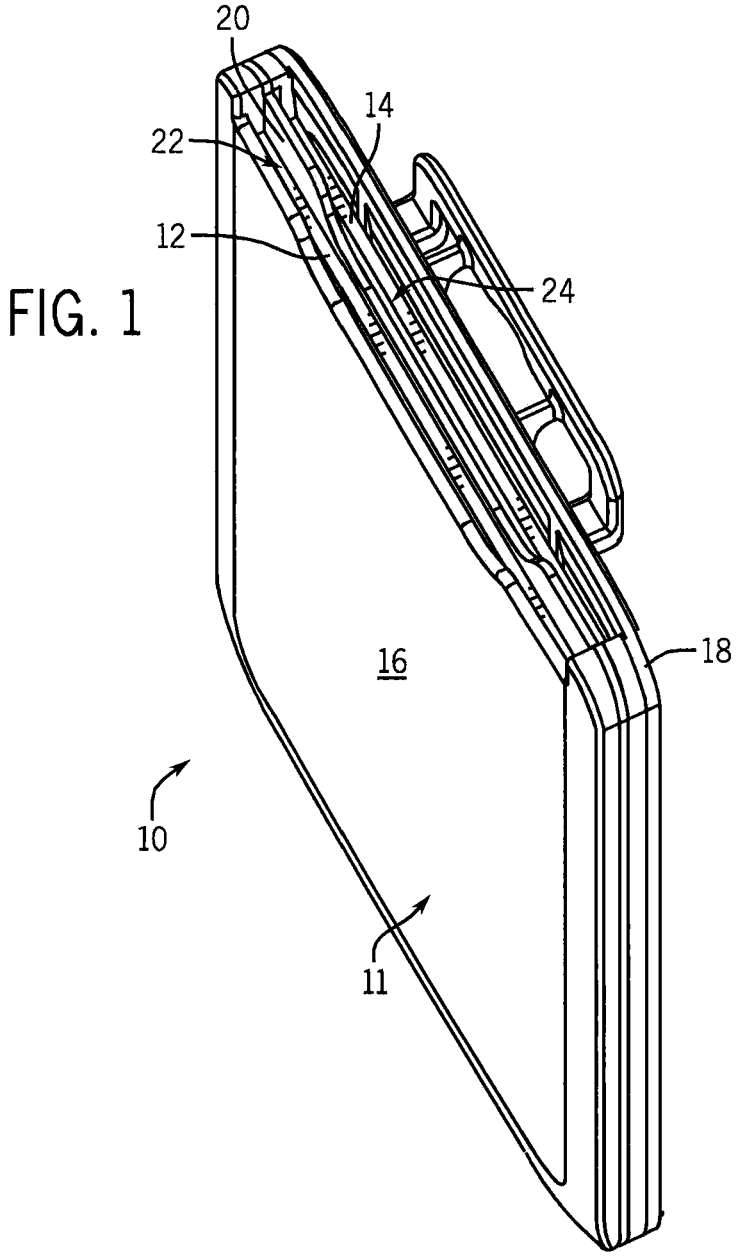
FIG. 1 is a perspective front view of one embodiment of a badge holder incorporating the present invention.
Figure 4:
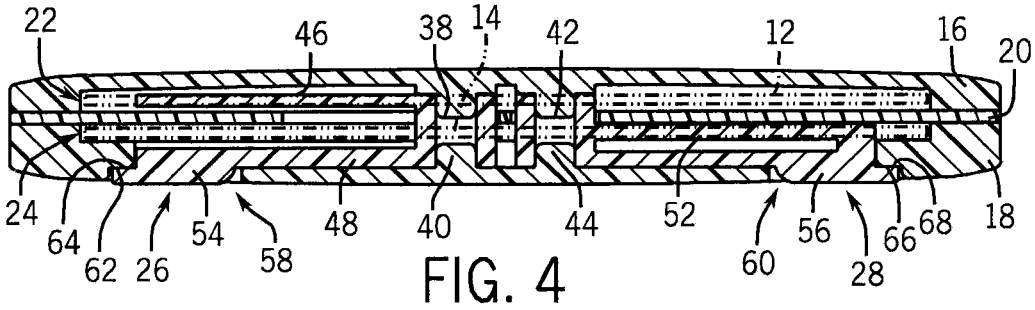
FIG. 4 is a cross-sectional view taken along line 4-4 from FIG. 3.

Notably, the badge holder 10 of FIGS. 1-6 also includes a first ejector 26 and a second ejector 28 near the edge of the badge holder 10 that is generally opposite to the edge on which the open ends of the holding slots 22, 24 are disposed. The first ejector 26 includes a proximal end 30 and a distal end 32. The second ejector 28 also includes a proximal end 34 and a distal end 36. The proximal ends 30, 34 of the ejectors 26, 28 are rotatably coupled to both the front piece 16 and the back piece 18 and have axes of rotation 76, 78 that are generally perpendicular to the major planar surfaces of the front and back pieces 16, 18 as well as the divider 20. As best shown in FIGS. 2 and 4, the first ejector 26 is coupled to a set of opposing pins 38 and 40. The pin 38 is centrally positioned on the front piece 16 near the edge of the badge holder 10 which is generally opposite to the edge of the holder 10 having the open ends of the holding slots 22, 24. This pin 38 extends toward the back piece 18. The pin 40 is also centrally positioned on the back piece 18 near the edge of the badge holder 10 that is generally opposite to the edge having the open ends of the holding slots 22, 24. This pin 40 extends toward the front piece 16. The second ejector 28 is rotatably coupled to both the front piece 16 and the back piece 18 in a similar fashion by coupling with pins 42, 44 that are centrally located on the front piece 16 and back piece 18, respectively. The sets of pins 38, 40 and 42, 44 are used to define parallel and spaced rotation axes 76, 78 of the first ejector 26 and the second ejector 28, respectively.

Although the ejectors 26, 28 are shown as being coupled to pins 38, 40, 42, 44 on both the front and back pieces 16, 18, it is contemplated that either ejector 26, 28 could be rotatably coupled to only one of the front piece 16 or the back piece 18, depending on the length of the pins. For example, pin 40 could be removed and pin 38 could be further extended along the axis of rotation 76 of the first ejector 26 such that first ejector 26 is only directly coupled to the front piece 16. Similarly, pin 42 could be removed and pin 44 could be extended along the axis of rotation 78 of the second ejector 28 such that the second ejector 28 is only directly coupled to the back piece 18.

Figure 9:
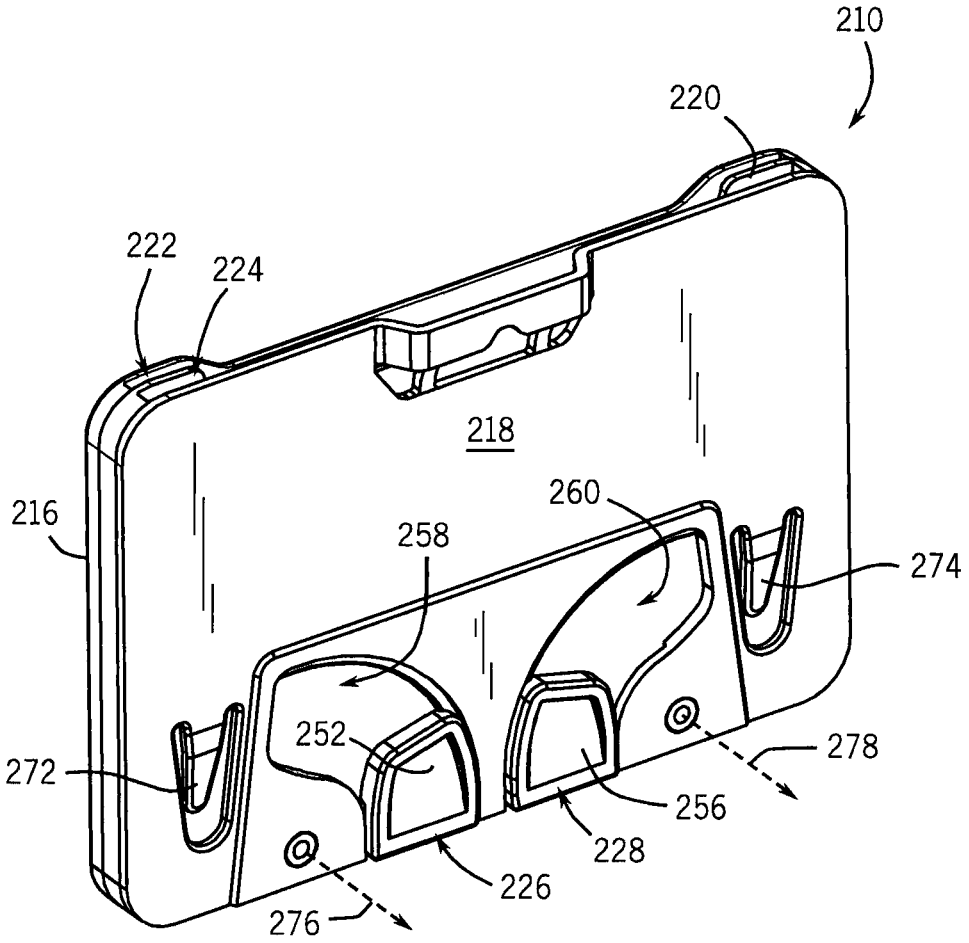
FIG. 9 is a rear perspective view of a third embodiment of a badge holder incorporating the present invention in which the ejectors have a different arrangement.

Another alternative, illustrated in FIG. 9, is to modify the badge holder 210 to position the axes 276, 278 toward the lateral sides (as opposed to centrally, as illustrated) and to position the portions of the ejectors 226, 228 that contact the cards for ejection more centrally (as opposed to laterally, as illustrated). In FIG. 9, like numbers are used to generally describe like elements from the other described embodiments in this specification, except that the numbers are in the 200 series (e.g, back piece 18 in the first embodiment corresponds to back piece 218 in this embodiment, and so on). In this arrangement, if the badge holder 210 is rearwardly viewed from its back side, the first ejector 226 would rotate counterclockwise and the second ejector 228 would rotate clockwise. One advantage of this flipped arrangement of the ejectors 226, 228 is that the portion of the respective ejector that contacts the badge or card to eject the badge or card would do so closer to the center of the lower edge of the badge or card (as opposed to a location closer to a lateral side of the lower edge) so as to more evenly lift the card. With this arrangement the badge is less likely to rotate within the slot and become stuck or snag on a lateral wall of the slot during ejection. Particularly if this outwardly swinging configuration of the ejectors is employed, then the ejectors may have lengths and paths of rotation that aim to maximize contact of the ejector about the center of the lower edge of the card. For example, the contacting portion of the ejector may be design to initially extend past the medial centerline of the card slot before the ejector is lifted such that, when the ejector is lifted and rotates, the point of contact between the ejector and card passes back over the centerline and the range of the points of contact between the ejected and card are roughly centered about this medial centerline. It is also noted that in this embodiment, the proximal ends of the ejectors extend through openings in the back piece 218 such that a radially outward facing surface of the proximal end bears on a radially inward facing surface of the opening in the back piece 216. This is an alternative to the pin arrangement described else where and may be used on one or both sides (e.g. front and back) of one or both of the ejectors.

Moreover, the pins might be substituted with other mechanisms for accommodating rotation of the ejectors 26, 28 about their proximal ends 30, 34. For example, the ejectors 26, 28 may alternatively be coupled to the front piece 16 and/or the back piece 18 by forming an opening in both of the front and back pieces 16, 18 and having an extended portion of the ejectors (akin to a shaft) received in and bear on these openings. Other coupling mechanisms including separate fasteners or bearing elements might also be employed.

As best shown in FIGS. 2 and 4, the first ejector 26 includes a first arm 46 and a second arm 48 which extend outwardly from the proximal end 30 and in a direction perpendicular to the axis of rotation 76 of the first ejector 26. The first arm 46 and the second arm 48 of the first ejector 26 are generally parallel to one another and form a U-shape that defines a badge passage 50, which will be discussed in greater detail below. The proximal end 30 of the first ejector 26 extends through an elongated aperture 80 in the divider 20 such that the first arm 46 is disposed in the first holding slot 22 while the second arm is on the opposite side of the divider 20 near the back piece 18. The elongated aperture 80 may be shaped so as to accommodate the assembly of the badge holder 11 in which the first ejector 26 will be inserted through the divider 20, such that the first ejector 26 extends through and the arms straddle the divider 20 once assembled.

The second ejector 28 includes a first arm 52, best shown in FIGS. 2 and 4, which extends outward and perpendicular to the axis of rotation 78 of the second ejector 28 within the second holding slot 24. As the rotating distal portion of the second ejector 28 is disposed within the second holding slot 24, only a small circular aperture 82 is formed in the divider 20 to accommodate the passage of a portion of the proximal end 34 therethrough to connect to the pin 42 on the front piece 16. However, the elongated aperture 80 and the circular aperture 82 could be switched with one another, and the first ejector 26 and the second ejector 28 could be switched with one another, such that the first ejector 26 still operates in both the first holding slot 22 and the second holding slot 24 and the second ejector 28 operates only in the second holding slot 24. Alternatively, the first ejector 26 could be positioned only in the first holding slot 22, between the divider 20 and the front piece 16, and the second ejector 28 could be positioned only in the second holding slot 24, between the divider 20 and the back piece 18. In this arrangement, the ejector slots 58, 60, described in detail below, would be oriented on the front piece 16 and the back piece 18, respectively.

Each ejector 26, 28 also includes an operating tab 54, 56 that is located on their distal ends 32, 36 as shown in FIGS. 2, 3, 4 and 5 and are accessible from the back piece 18 of badge holder 10.

Figure 3:
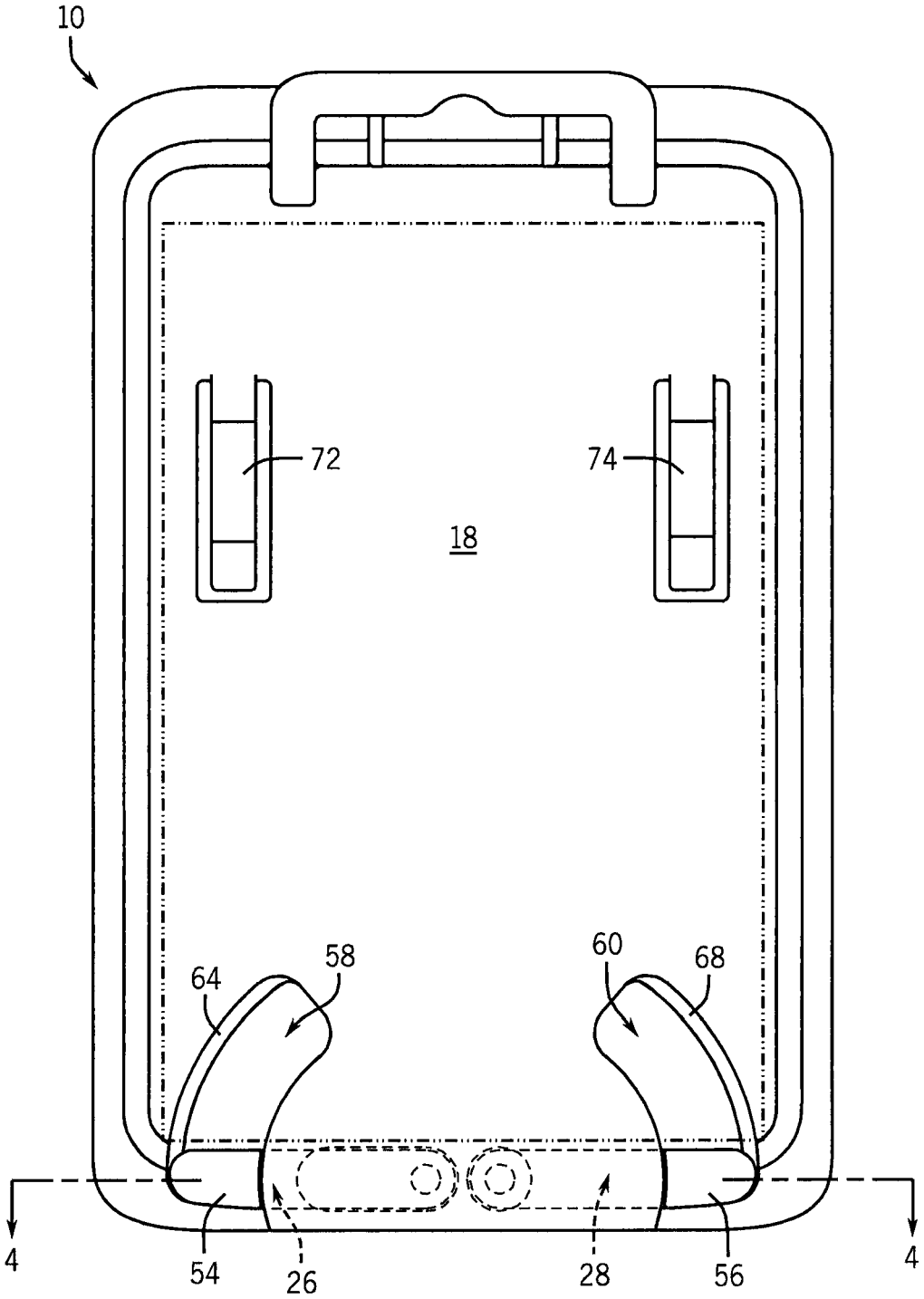
FIG. 3 is a rear elevational view thereof.

The housing 11 also includes a first ejector slot 58 and a second ejector slot 60, each ejector slot 58, 60 having an arcuate shape. In the embodiment shown in FIGS. 1-6, the first ejector slot 58 and the second ejector slot 60 are both located in the back piece 18, however, each ejector slot 58, 60 may alternatively be disposed on the front piece 16. The ejector slots 58, 60 provide access to operate the ejectors 26, 28. As best shown in FIGS. 3 and 4, the operating tab 54 on the first ejector 26 extends through the first ejector slot 58 and the operating tab 56 on the second ejector 28 extends through the second ejector slot 60. The ejector slots 58, 60 are arcuate in shape to guide the rotation of the operating tabs 54, 56 about the axes of rotation 76, 78 of the ejectors 26, 28, as will be discussed in detail below. As best shown in FIGS. 3 and 4, operating tab 54 includes a lip 62 that is supported on surface 64 on the first ejector slot 58. Similarly, operating tab 56 includes a lip 66 that is supported on surface 68 on the second ejector slot 60. The interaction between the lips 62, 66 and their respective surfaces 64, 68 also help provide stability during the rotation of the ejectors 26, 28.

Turning now to FIG. 2, the badge holder 10 can retain two badges 12, 14. A user inserts the first badge 12 into the first holding slot 22 and inserts the second badge 14 into the second holding slot 24, such that the edge, which is perpendicular to the axes of rotation 76, 78 of the ejectors 26, 28, of the first badge 12 and the second badge 14 rests on the first arm 46 and the arm 52 of the ejectors 26, 28, respectively. A retainer clip 70 is centrally positioned on a portion of the divider 20 near the openings of the holding slots 22, 24. The retainer clip 70 assists in retaining the first badge 12 in the first holding slot 22 by applying a force to a planar face of the first badge 12. Similarly, retainer clips 72, 74 are laterally positioned on a portion of the back piece 18 near the opening of the holding slots 22, 24. The retainer clips 72, 74 assist in retaining the second badge 14 in the second holding slot 24. Alternatively, the divider 20 could include retainer clips oriented similar to the retainer clips 72, 74 on the back piece 18. Likewise, the back piece 18 could include a single retainer clip, similar to the retainer clip 70 on the divider 20. The combination of arrangements of the retainer clips, 70, 72, and 74 described above could also be oriented in a similar fashion on the front piece 16 of the badge holder 10.

Figure 5:
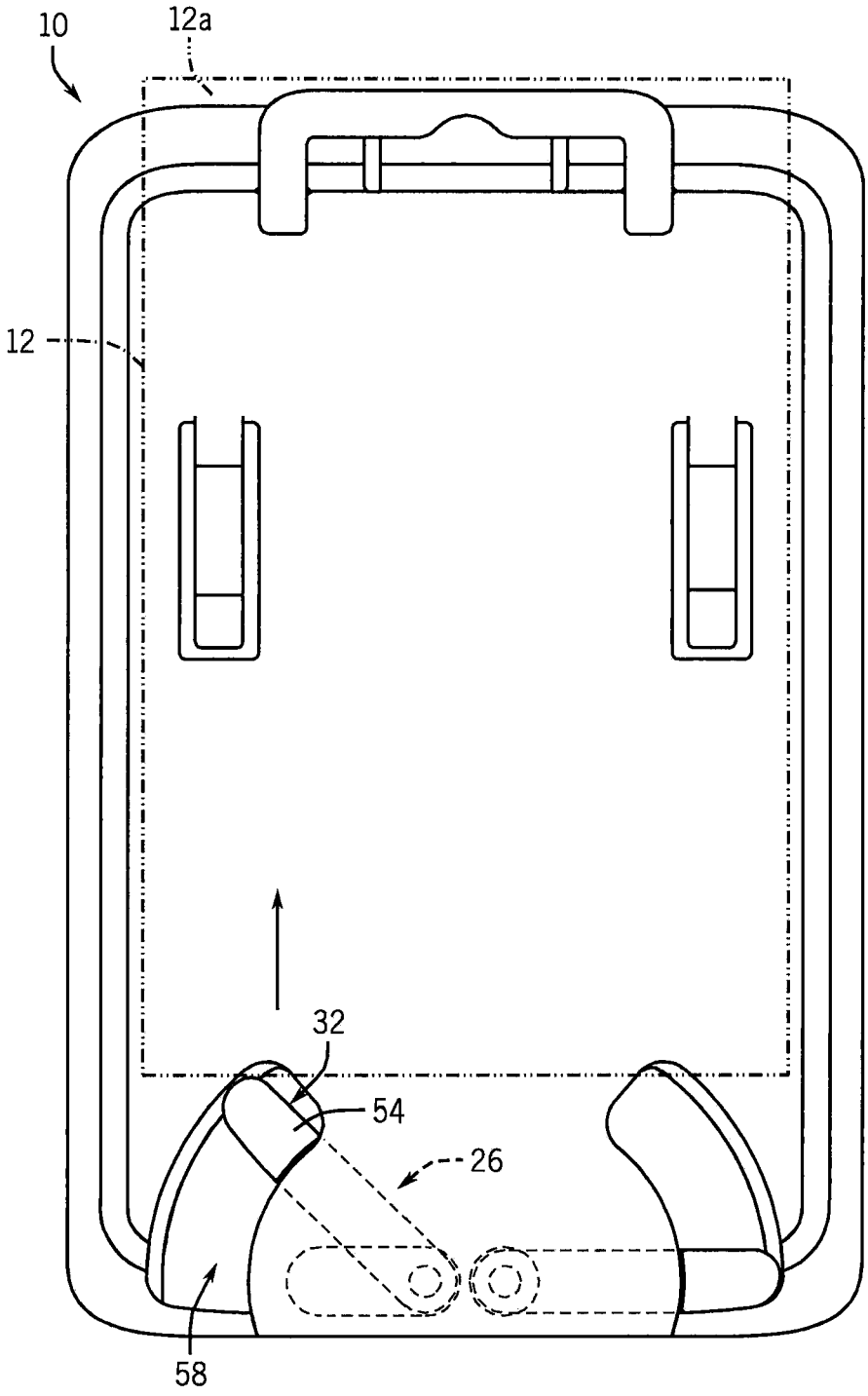
FIG. 5 is a rear elevational view thereof, showing a first ejector partially removing a first card.
Figure 6:
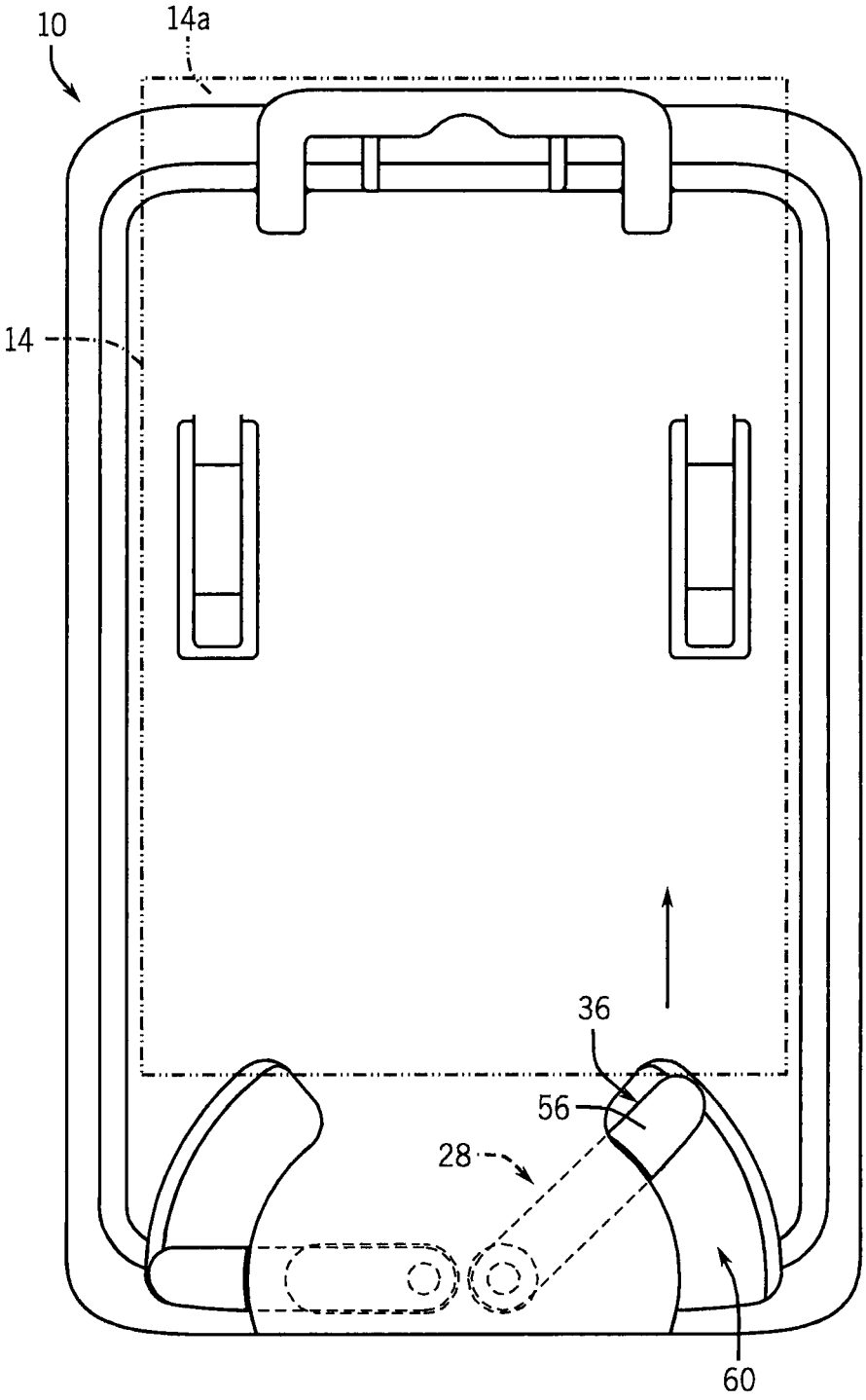
FIG. 6 is a rear elevational view thereof, showing a second ejector partially removing a second card.

Turning now to FIGS. 5 and 6, the operation of the ejectors 26, 28 will now be described. As shown in FIG. 5, if the user wishes to remove the first badge 12 from the first holding slot 22, the user will slide the operating tab 54 of the first ejector 26 in an upward direction, following the arcuate path of the first ejector slot 58. Doing so will cause the distal end 32 of the first ejector 26 to rotate about the axis of rotation 76 of the first ejector 26 in the first holding slot 22 and the first arm 46 will contact the first badge 12 thereby removing a portion 12*a* of the first badge 12 from the first holding slot 22. The user can then grab the portion 12*a* to fully remove the first badge 12 from the badge holder 10, if desired. Notably, the rotation of the first ejector 26 does not cause the second badge 14 to be removed. As shown in FIGS. 2 and 4, the rotation of the first ejector 26 allows the first arm 46 of the first ejector 26 to contact the first badge 12, but the badge passage 50 between the U-shape formed by the first arm 46 and second arm 48 allows the first ejector 26 to be rotated without contacting or removing the second badge 14. Therefore, the badge passage 50 provides clearance for the second badge 14, as well as the divider 20, such that rotation of the first ejector 26 only removes the first badge 12, and not the second badge 14.

As shown in FIG. 6, if the user wishes to remove the second badge 14 from the second holding slot 24, the user can slide the operating tab 56 in an upward direction, following the arcuate path of the second ejector 28 in the second ejector slot 60. The rotation of the second ejector 28 about the axis of rotation 78 will cause the distal end 36 of the second ejector 28 to rotate in the second holding slot 24 and the arm 52 will contact the second badge 14, removing a portion of the second badge 14*a* from the second holding slot 24. The user can then grab the portion 14*a* to fully remove the second badge 14 from the badge holder 10. Similar to the rotation of the first ejector 26 described above, the rotation of the second ejector 28 does not cause the first badge 12 to be removed. As shown in FIGS. 2 and 4, rotation of the second ejector 28 causes the arm 52 to contact the second badge 14, but the arm 52 does not extend into the first holding slot 22. Thus, rotation of the second ejector 28 allows clearance for the first badge 12 such that rotation of the second ejector 28 only engages the second badge 14, and not the first badge 12. Thus, one advantage of the badge holder 10 is that it allows a user to use the ejectors 26, 28 selectively to remove only the desired badge, even when the ejectors are disposed on the same side of the holder.

Figure 7:
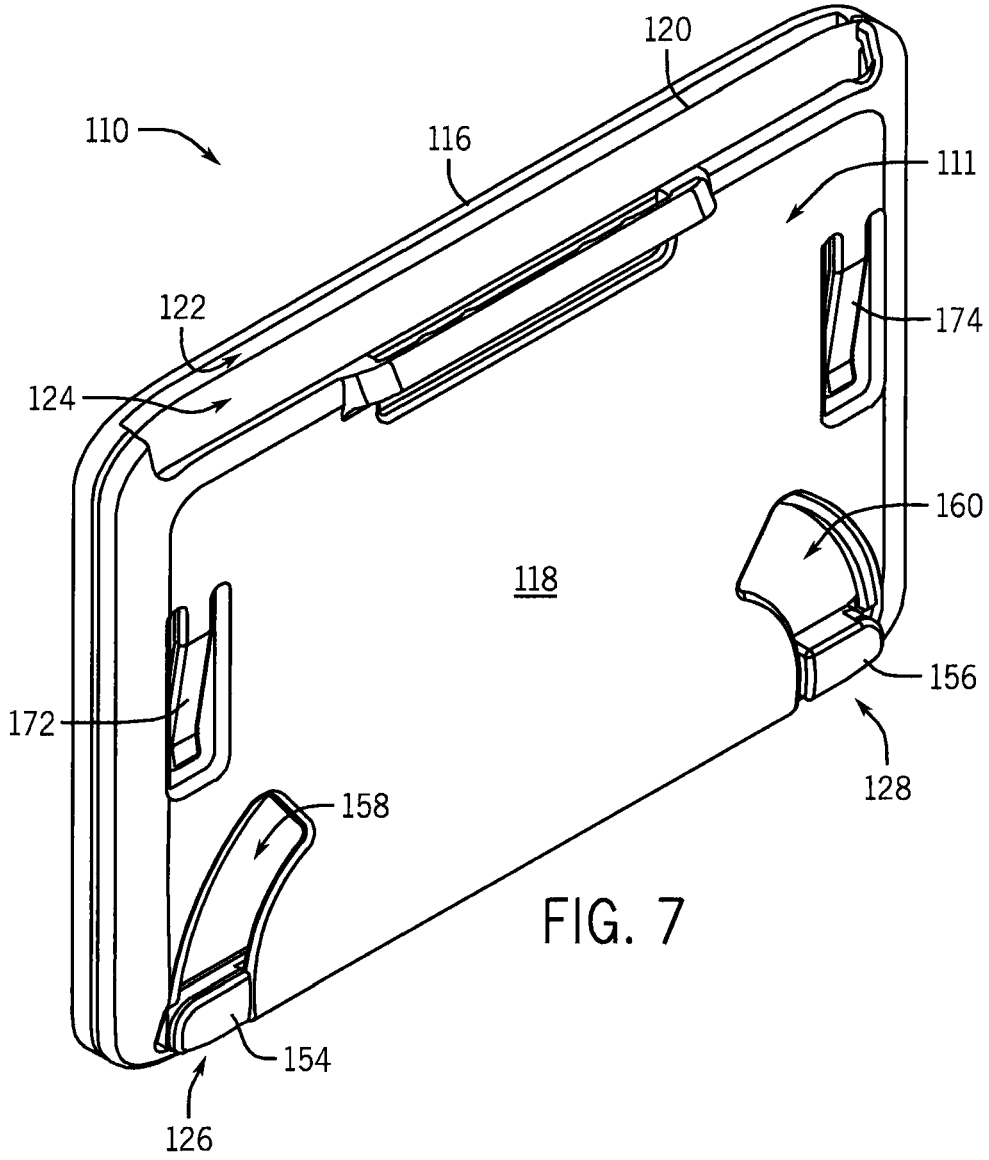
FIG. 7 is a perspective rear view of a second embodiment of a badge holder incorporating the present invention.
Figure 8:
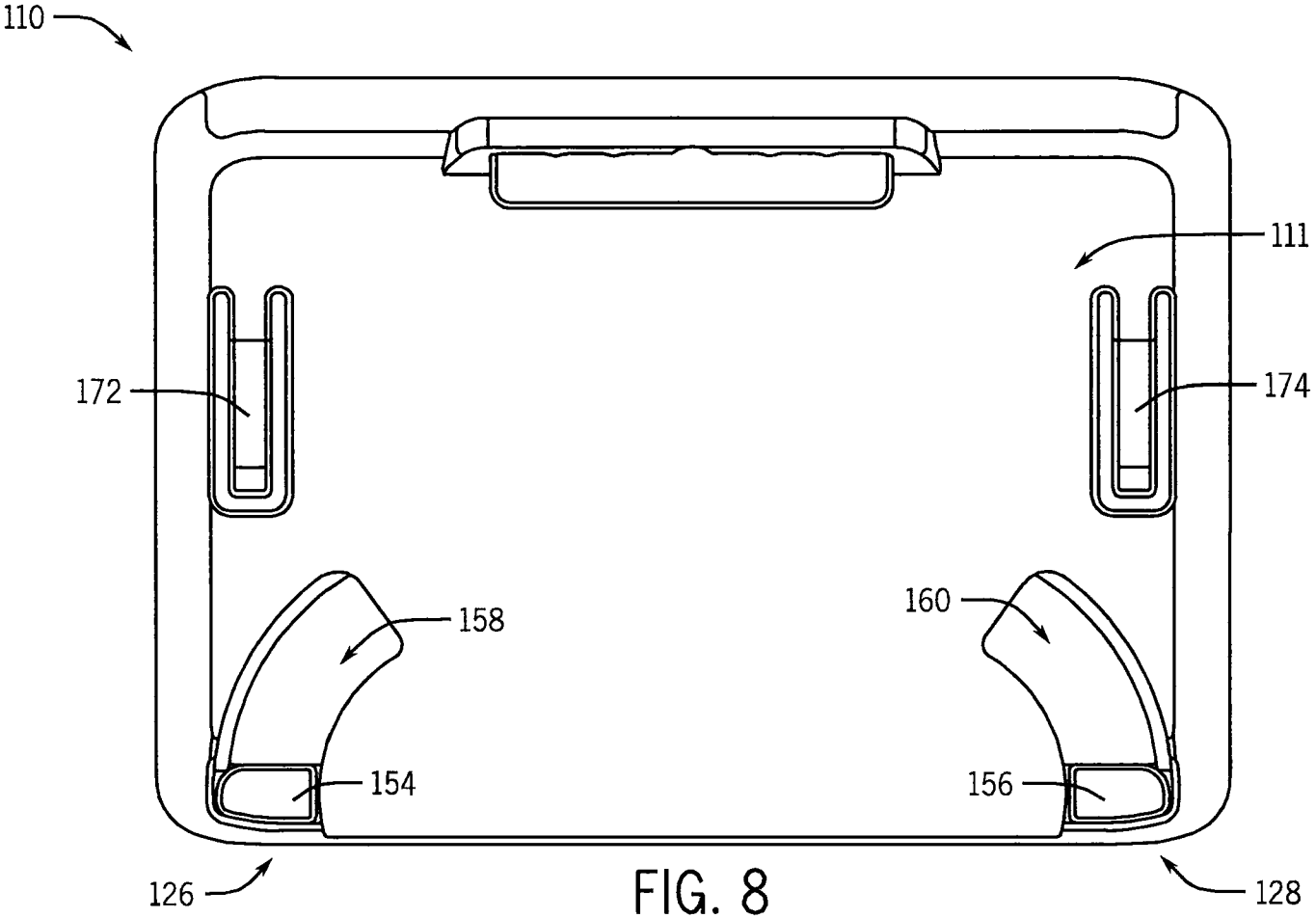
FIG. 8 is a rear elevational view of the badge holder of FIG. 7.

A second embodiment of a badge holder 110 is illustrated in FIGS. 7 and 8. The badge holder 110 contains similar features and is designed to function in a similar manner as compared to the badge holder 10 as described above and as illustrated in FIGS. 1-6. The badge holder 110 includes a housing 111 that includes a front piece 116, a back piece 118, and a divider 120. The divider 120 defines a first holding slot 122 and a second holding slot 124. The back piece 118 of the badge holder 110 can include retainer clips 172, 174 for retaining a badge in the second holding slot 124. The divider 120 can include a retainer clip (not shown) for holding a badge in the first holding slot 122.

Similar to the badge holder 10, the badge holder 110 shown in FIGS. 7 and 8 includes a first ejector 126 and a second ejector 128. The first ejector 126 is rotatably coupled to the housing 111, as described above, and includes an operating tab 154 in a first ejector slot 158. The first ejector slot 158 has an arcuate shape to guide the rotation of the operating tab 154. The second ejector 128 is also rotatably coupled to the housing 111 and includes an operating tab 156 in a second ejector slot 160. The second ejector slot 160 has an arcuate shape to guide the rotation of the operating tab 154. The first ejector 126 is spaced further from the second ejector 128 in the badge holder 110 as compared to the spacing of the first ejector 26 from the second ejector 28 of the badge holder 10 due to the horizontal orientation of the housing 111. The length of the housing 111 is greater than the height of the housing 111. Such an orientation may be preferable for holding badges or cards containing writing or graphics that are oriented in a horizontal fashion so that those badges or cards can be displayed and read through the housing 111 more easily. Additionally or alternatively, the horizontal orientation of the housing 111 for the badge holder 110 and spacing of the ejectors 126, 128 as shown in FIGS. 7 and 8 may be preferable by some users as compared to the vertical orientation of the housing 11 of the badge holder 10 and spacing of the ejectors 26, 28 as shown in FIGS. 1-6.

A user can independently manipulate the first ejector 126 and/or the second ejector 128 to selectively eject one or more of the badges (not shown) held within the first holding slot 122 and the second holding slot 124 of the badge holder 110 in a similar manner as described above with respect to the ejectors 26, 28 of the badge holder 10.

It should be understood that the apparatuses and processes described above are only exemplary and do not limit the scope of the invention, and that various modifications could be made by those skilled in the art that would fall under the scope of the invention. For example, the orientation of which ejector 26, 28 and 126, 128 removes which badge 12, 14 can be adjusted as desired. Additionally, the ejectors 26, 28 or 126, 128 can be configured such that one or both of the ejectors 26, 28 or 126, 128 removes more than one badge 12, 14.

Having now described some illustrative embodiments of the invention, it should be apparent to those skilled in the art that the foregoing is merely illustrative and not limiting, having been presented by way of example only. Numerous modifications and other illustrative embodiments are within the scope of one of ordinary skill in the art and are contemplated as falling within the scope of the invention. In particular, although many of the examples presented herein involve specific combinations of method acts or system elements, it should be understood that those acts and those elements may be combined in other ways to accomplish the same objectives. Acts, elements and features discussed only in connection with one embodiment are not intended to be excluded from a similar role in other embodiments.

Use of ordinal terms such as "first", "second", "third", etc., in the claims to modify a claim element does not by itself connote any priority, precedence, or order of one claim element over another, but are used merely as labels to distinguish one claim element having a certain name from another element having a same name (but for use of the ordinal term) to distinguish the claim elements.

Thus, the invention is to cover all modifications, equivalents, and alternatives falling within the spirit and scope of the invention as defined by the following appended claims. To apprise the public of the scope of this invention, the following claims are made.

What is claimed is:

1. A badge holder for holding a badge, the badge holder comprising:

a front piece;

a back piece opposite the front piece, the back piece coupled to the front piece to provide a holding slot for the badge;

a first ejector having a first arm, a first proximal end and a first distal end, the first proximal end rotatably coupled to at least one of the front piece and the back piece, the first ejector being configured to rotate such that the first arm of the first distal end forces at least a portion of the badge out of the holding slot.

2. The badge holder of claim 1, further comprising:

a first ejector slot, the first ejector slot providing access to operate the first ejector.

3. The badge holder of claim 2, wherein the first ejector slot is arcuate in shape.

4. The badge holder of claim 2, wherein the first ejector further includes a first operating tab, the first operating tab extending through the first ejector slot.

5. The badge holder of claim 1, further comprising:

a second ejector having a second proximal end and a second distal end, the second proximal end rotatably coupled to at least one of the front piece and the back piece, the second ejector being configured to rotate such that the second distal end forces at least a portion of the badge out of the holding slot.

6. The badge holder of claim 5, wherein the badge holder has a first lateral edge and a second lateral edge that is opposed to the first lateral edge and wherein the first proximal end of the first ejector is positioned closer to the first lateral edge of the badge holder than the first distal end and the second proximal end of the second ejector is positioned closer to the second lateral edge than second distal end.

7. The badge holder of claim 5, further comprising:

a first ejector slot, the first ejector slot providing access to operate the first ejector; and a second ejector slot, the second ejector slot providing access to operate the second ejector;

wherein the first ejector further includes a first operating tab, the first operating tab extending through the first ejector slot, and the second ejector further includes a second operating tab, the second operating tab extending through the second ejector slot.

8. The badge holder of claim 7, wherein the first ejector slot and the second ejector slot are in the back piece.

9. The badge holder of claim 1, wherein at least one of the front piece and the back piece include a pin projecting toward the holding slot, the first ejector being rotatably coupled to the pin.

10. A badge holder for holding a first badge and a second badge, the badge holder comprising:

a housing comprising:

a front piece;

a back piece opposite from the front piece; and a divider between the front piece and the back piece, the divider coupled to the front piece and the back piece and providing a first holding slot for the first badge and a second holding slot for the second badge;

a first ejector having a first proximal end and a first distal end, the first proximal end rotatably coupled to the housing, the first ejector configured to rotate in the first holding slot such that the first distal end contacts the first badge and forces at least a portion of the first badge out of the first holding slot; and a second ejector having a second proximal end and a second distal end, the second proximal end rotatably coupled to the housing, the second ejector configured to rotate in the second holding slot such that the second distal end contacts the second badge and forces at least a portion of the second badge out of the second holding slot.

11. The badge holder of claim 10, wherein the first ejector rotates in the first holding slot to force at least a portion of the first badge out of the first holding slot without forcing at least a portion of the second badge out of the second holding slot.

12. The badge holder of claim 11, wherein the second ejector rotates in the second holding slot to force at least a portion of the second badge out of the second holding slot without forcing at least a portion of the first badge out of the first holding slot.

13. The badge holder of claim 12, wherein the first ejector further includes a badge passage, the badge passage providing clearance for the second badge when the first ejector rotates such that the first ejector does not force at least a portion of the second badge out of the second holding slot.

14. The badge holder of claim 13, wherein the first ejector further includes a first arm and a second arm, the badge passage being defined between the first arm and second arm, the first arm rotating in the first holding slot for contacting the first badge.

15. The badge holder of claim 10, wherein the housing further comprises a first ejector slot and a second ejector slot, the first ejector slot providing access to operate the first ejector and the second ejector slot providing access to operate the second ejector.

16. The badge holder of claim 15, wherein at least one of the front piece and the back piece includes a first pin and at least one of the front piece and the second piece includes a second pin, the first ejector rotatably coupled to the first pin and the second ejector rotatably coupled to the second pin.

17. The badge holder of claim 15, wherein the first ejector further includes a first operating tab and the second ejector further includes a second operating tab, the first operating tab extending through the first ejector slot and the second operating tab extending through the second ejector slot.

18. The badge holder of claim 17, wherein the first ejector includes a first arm and a second arm, a badge passage being defined between the first arm and the second arm, the first operating tab being on the second arm.

19. The badge holder of claim 18, wherein the second ejector includes an arm that forces at least a portion of the badge out of the holding slot when the second ejector is rotated.

20. The badge holder of claim 15, wherein the first ejector slot and the second ejector slot are in the back piece of the housing.

21. A badge holder for holding a first badge and a second badge, the badge holder comprising:

a housing comprising:

a front piece;

a back piece opposite from the front piece and spaced apart from the front piece;

a badge divider between the front piece and the back piece, the badge divider coupled to the front piece and the back piece and providing a first holding slot for the first badge and a second holding slot for the second badge;

a first pin; and a second pin;

a first ejector having a first arm, a first proximal end and a first distal end, the first proximal end rotatably coupled to the first pin, the first ejector configured to rotate about the first pin in the first holding slot such that the first arm of first distal end contacts the first badge and forces at least a portion of the first badge out of the first holding slot; and a second ejector having a second proximal end and a second distal end, the second proximal end rotatably coupled to the second pin, the second ejector configured to rotate in the second holding slot such that the second distal end contacts the second badge and forces at least a portion of the second badge from the second holding slot, wherein the first ejector forces the portion of the first badge out of the first holding slot without forcing the portion of the second badge out of the second holding slot, and the second ejector forces the portion of the second badge out of the second holding slot without removing the portion of the first badge out of the first holding slot.

22. The badge holder of claim 21, wherein the back piece includes a first ejector slot and a second ejector slot, the first ejector slot providing access to operate the first ejector and the second ejector slot providing access to operate the second ejector.

* * * * *